US010869517B1

(12) United States Patent
Halpern

(10) Patent No.: US 10,869,517 B1
(45) Date of Patent: Dec. 22, 2020

(54) FOLDING HAT WITH INTEGRATED DISPLAY SYSTEM

(71) Applicant: Nexus House LLC, Mill Valley, CA (US)

(72) Inventor: Ian Loren Halpern, Mill Valley, CA (US)

( * ) Notice: Subject to any disclaimer, the term of this patent is extended or adjusted under 35 U.S.C. 154(b) by 0 days.

(21) Appl. No.: 15/991,922

(22) Filed: May 29, 2018

Related U.S. Application Data

(60) Provisional application No. 62/512,045, filed on May 28, 2017.

(51) Int. Cl.

| | |
|---|---|
| ***A42B 1/20*** | (2006.01) |
| ***A42B 1/06*** | (2006.01) |
| *A42B 3/22* | (2006.01) |
| *A42B 3/32* | (2006.01) |
| *A42B 1/08* | (2006.01) |

(52) U.S. Cl.
CPC ..... *A42B 1/201* (2013.01); *A42B 1/064* (2013.01); *A42B 1/206* (2013.01); *A42B 1/008* (2013.01); *A42B 1/06* (2013.01); *A42B 1/062* (2013.01); *A42B 1/063* (2013.01); *A42B 1/08* (2013.01); *A42B 1/20* (2013.01); *A42B 3/22* (2013.01); *A42B 3/223* (2013.01); *A42B 3/32* (2013.01); *A42B 3/322* (2013.01); *A42B 3/324* (2013.01)

(58) Field of Classification Search
CPC ..... A42B 1/201; A42B 1/064; A42B 1/206; A42B 1/008; A42B 1/06; A42B 1/20; A42B 1/062; A42B 1/063; A42B 1/08; A42B 3/22; A42B 3/223; A42B 3/32; A42B 3/322; A42B 3/324
USPC ..... 2/171.3
See application file for complete search history.

(56) References Cited

U.S. PATENT DOCUMENTS

| | | | |
|---|---|---|---|
| 441,380 | A | 11/1890 | Ray |
| 1,418,198 | A | 5/1922 | Neppel |
| 1,526,322 | A | 2/1925 | Dehne |
| 2,227,554 | A | 1/1941 | Riordon |
| 2,467,839 | A | 4/1949 | Maher |
| 2,623,213 | A | 12/1952 | Provitola et al. |
| 3,869,727 | A | 3/1975 | Hartman et al. |

(Continued)

FOREIGN PATENT DOCUMENTS

| | | |
|---|---|---|
| CN | 103345064 | 10/2013 |
| CN | 204561084 | 8/2015 |
| KR | 101787508 | 11/2017 |

OTHER PUBLICATIONS

Augmented Reality for the Modern Workforce website in 8 pages, available at https://www.mirareality.com, accessed Jun. 11, 2018.

*Primary Examiner* — Khaled Annis
*Assistant Examiner* — Dakota Marin
(74) *Attorney, Agent, or Firm* — Knobbe, Martens, Olson & Bear LLP

(57) ABSTRACT

A folding hat can include an integrated display system. Methods for folding and manufacturing the hat with integrated displays are also disclosed. The hat can include a visor and cap of various materials integrated with displays. The hat can have hinges that fold the assembly into a small volume for stowing. The hinges are configurable in a multitude of positions and geometries to provide different folding techniques and folded geometries. Such configurations allow for a range of options for carrying and storing the folding hat with integrated display system.

18 Claims, 19 Drawing Sheets

(56) References Cited

U.S. PATENT DOCUMENTS

| | | | | | |
|---|---|---|---|---|---|
| 4,549,316 | A * | 10/1985 | Johnson | A42B 1/201 | 2/195.1 |
| 4,951,319 | A * | 8/1990 | Phillips, Jr. | A42B 1/04 | 2/172 |
| 4,999,852 | A | 3/1991 | Murray | | |
| 5,173,970 | A * | 12/1992 | Shifrin | A42B 1/08 | 2/209.12 |
| 5,247,709 | A * | 9/1993 | Epply | A42B 1/208 | 2/175.1 |
| 5,388,272 | A * | 2/1995 | Epply | A42B 1/201 | 2/175.1 |
| 5,450,629 | A | 9/1995 | Gilstrap | | |
| 5,657,490 | A | 8/1997 | Edmark | | |
| 5,741,060 | A | 4/1998 | Johnson | | |
| 5,802,616 | A | 9/1998 | Watson | | |
| 5,822,800 | A | 10/1998 | Anderson | | |
| 5,845,339 | A | 12/1998 | Ashley et al. | | |
| 5,950,241 | A | 9/1999 | Gomez | | |
| 5,960,477 | A | 10/1999 | Dixon | | |
| 6,237,159 | B1 | 5/2001 | Martin | | |
| 6,311,331 | B1 * | 11/2001 | Park | A42B 1/063 | 2/175.1 |
| 6,317,892 | B1 | 11/2001 | Galigani | | |
| 6,453,475 | B1 * | 9/2002 | Johnson | A42B 1/201 | 2/175.1 |
| 6,804,831 | B2 * | 10/2004 | Guerra | A42B 1/065 | 2/195.2 |
| 7,152,251 | B2 * | 12/2006 | Yan | A42B 1/064 | 2/195.6 |
| 7,168,100 | B2 * | 1/2007 | Kronenberger | A42B 1/063 | 2/171.03 |
| 7,937,778 | B1 * | 5/2011 | Norton | A42B 1/08 | 2/175.4 |
| 8,201,862 | B2 | 6/2012 | Langley | | |
| 8,488,246 | B2 | 7/2013 | Border et al. | | |
| 9,696,552 | B1 | 7/2017 | Goergen et al. | | |
| 2004/0117893 | A1 | 6/2004 | Ginsberg | | |
| 2006/0015985 | A1 * | 1/2006 | Kim | A42B 1/064 | 2/171 |
| 2008/0309586 | A1 | 12/2008 | Vitale | | |
| 2015/0205126 | A1 | 7/2015 | Schowengerdt | | |
| 2017/0103440 | A1 | 4/2017 | Xing et al. | | |
| 2018/0017796 | A1 | 1/2018 | Toso | | |
| 2018/0050267 | A1 | 2/2018 | Jones | | |
| 2018/0113317 | A1 | 4/2018 | DeBates et al. | | |

* cited by examiner 11
5
2
H 3
4
2
5
H 3
5
H

1000

3
206
2
201
51
208
52
202

1000
2
52
51

1100
201
1100
7
6
7
6
202

1200

2
60
600

2
60

2
60

2
60
602

2
60

FOLDING HAT WITH INTEGRATED DISPLAY SYSTEM

INCORPORATION BY REFERENCE

This application claims the benefit under 35 U.S.C. § 119(e) as a nonprovisional application of U.S. Pat. App. No. 62/512,045 filed on May 28, 2017, which is hereby incorporated by reference in its entirety.

BACKGROUND

Some aspects of the present invention relate generally to a hat with an integrated display system that folds into a small thin package. More particularly, some embodiments of the invention relate to foldable hat device systems that can be stowed in pockets and bags, and used to display data and graphical user interfaces.

SUMMARY

Disclosed herein are systems and methods for folding a hat into a small thin package for storage. The method can include, in some embodiments, providing a hat comprising a visor having a front end, a rear end, and a hinged body, and a cap operably connected to the visor. The system and method can also include a visor without a cap. The system and method can also include an adjustable tether. The method can also include mechanically coupling one or more of the ends of the visor or cap to one or more tethers. The method can further include an adjustable tether that mechanically couples to itself, the visor, or the cap. The method can further include an adjustable tether that mechanically decouples to itself, the visor, or the cap. The visor can include, for example, a hinged body that includes a central hinge and a transverse hinge. In some embodiments, folding the hat to a desired thickness includes folding along a central hinge within the visor (e.g., between the back edge of the visor and the front end of the cap). In other embodiments, folding the hat to a desired thickness includes folding along a transverse hinge within the visor. In some embodiments, folding the hat to a desired thickness includes moving the tether toward the front edge of the visor. In some embodiments, folding the hat to a desired thickness includes mechanically coupling the tether to the visor more than once. In some embodiments, the tether is decoupled to allow the rear end of the visor to fold flat. The tether can include a hook, and/or a releasable connector.

In some embodiments, mechanically coupling the tether to the visor can include looping it around the front edge of the visor, through an aperture, or other complementary element of the visor. Mechanically decoupling the tether to a portion of the visor can include disassociating the tether from itself, the front end of the visor, or an aperture on the visor.

Also disclosed herein is a method for manufacturing a visor to fold flat. The method can also include, in some embodiments, a hat including a visor and a cap.

In some embodiments, disclosed is a display system configured for integration with the hat. The hat can include can include one or more operably coupled displays. A portion of the display can be configured to extend away from the visor, and be placed near a surface of the visor in a second configuration. The displays can include a rectangular form. The display is configured to nest a portion of itself within the hat. The display can include, in some cases, a pivoting joint connected to the visor. The display system can also include one, two, or more extending displays configured to allow a user to position the displays within a target location. The hat can be configured to house a portion of the display therethrough, thereby coupling the display and the hat. In some embodiments, the display can include a hinge axially with respect to an edge of the display. The display can be configured to stow away and extend into view as desired by the user.

In some embodiments, disclosed herein is a display that provides directions to a target location, including arrows, location data, words, and audible information. In some embodiments, the display can include position, altitude, speed, acceleration, and other forms of data useful to travel, research, and athletic performance. In some embodiments, disclosed herein is a display that provides audio and video data.

Also disclosed herein is a method for the user to interact with the display system. In some embodiments, disclosed herein is a display that provides a screen for the user to interact with via touch, voice, eye tracking, or biological sensing.

Also disclosed herein is a wearable hat. The hat can be configured to fold flat or substantially flat. The hat can include any number of a cap portion including a front end and a back end, and an interior volume configured to house the head of a user when the hat is in an expanded configuration, and a visor portion extending proximally from the front end of the cap portion. The visor portion can include a superior surface, an inferior surface opposite the superior surface, a transverse axis demarcating a first lateral zone and a second lateral zone, each lateral zone having a lateral free edge. The visor portion can also include a hinge along the transverse axis configured to allow the visor portion to fold along the transverse axis. The inferior surface can include a plurality of spaced-apart complementary reversible locking elements proximate each of the lateral free edges, the reversible locking elements configured to reversibly mate when the hat assumes a folded configuration and the first lateral zone contacts the second lateral zone. In some embodiments, only one, at least one, or both of the locking elements can include: hook-and-loop fastener material, a magnet, magnetic material, a metal, snap button components, a clip, or others. The cap can also include a hinge along a central axis between a back edge of the visor portion and the front end of the cap portion, the hinge configured to fold the hat along the central axis. The hinge could be the only hinge of the cap portion, or additional hinges could be present.

Also disclosed herein is a wearable hat configured to fold flat or substantially flat. The hat can include any number of a cap portion including a front end and a back end, an interior volume configured to house the head of a user when the hat is in an expanded configuration, and a longitudinal axis demarcating a first lateral zone, a second lateral zone, and a hinge therebetween configured to allow folding of the cap portion along the longitudinal axis. The first lateral zone and the second lateral zone each can include a panel at the front end of the cap portion connected by the hinge. In some embodiments, the hinge comprises a valley between panels of the cap portion. The panels can be situated in between a plurality of fabric layers of the cap portion, the panels made of a material that is more rigid than that of the fabric layers. A visor portion can extend proximally from the front end of the cap portion. The visor portion can include a superior surface, an inferior surface opposite the superior surface, a transverse axis demarcating a first lateral zone and a second lateral zone, each lateral zone having a lateral free edge. The visor portion can also include a hinge along the transverse configured to allow the visor portion to fold along the transverse axis. In some embodiments, the hinge comprises a central valley between panels of the visor portion. In some embodiments, the inferior surface of the visor portion can include a plurality of spaced-apart complementary reversible locking elements proximate each of the lateral free edges. The reversible locking elements can be configured to reversibly mate when the hat assumes a folded configuration and the first lateral zone contacts the second lateral zone. The panels can, or in other cases do not extend into the back end of the cap portion. The visor can include a plurality of side arms and a tether operably connected to the side arms. Actuating the tether toward the front of the visor causes the hat to transform from an expanded wearable configuration to a folded configuration utilizing only one hand. Also or in addition, actuating the tether toward the back of the visor can cause the hat to transform from the folded configuration back to the expanded wearable configuration utilizing only one hand. In some embodiments, in the folded configuration a portion of the tether extends beyond a front edge of the visor portion.

Also disclosed herein is a wearable hat configured to fold flat or substantially flat. The hat can include any number of a cap portion including a front end and a back end, an interior volume configured to house the head of a user when the hat is in an expanded configuration, and a transverse axis demarcating a first lateral zone, a second lateral zone, and a hinge therebetween configured to allow folding of the cap portion along the transverse axis; and a visor portion extending proximally from the front end of the cap portion; the visor portion including a superior surface, an inferior surface opposite the superior surface, and a transverse axis demarcating a first lateral zone and a second lateral zone, each lateral zone having a lateral free edge. The visor portion can include one, two, or more material layers sandwiched in between a plurality of fabric layers, the material layer including a void and a bridge portion interconnecting the first lateral zone and the second lateral zone such that the visor maintains a radius in a folded state and does not bend into a sharp fold. The visor can also include a hinge along the transverse axis of the visor configured to allow the visor portion to fold along the transverse axis. The bridge portion can be either in front, in back, lateral, or medial to the void or voids. The bridge portion could be made of the same material, or a different material as the material layer of the first lateral zone and the second lateral zone of the visor portion. The bridge portion could include a resilient material, such as spring steel for example. The bridge portion could also include a plastically deformable polymer. The void can be between about, for example, 5% and about 50% of the total surface area of the material layer of the visor portion.

DETAILED DESCRIPTION

Figure 1:
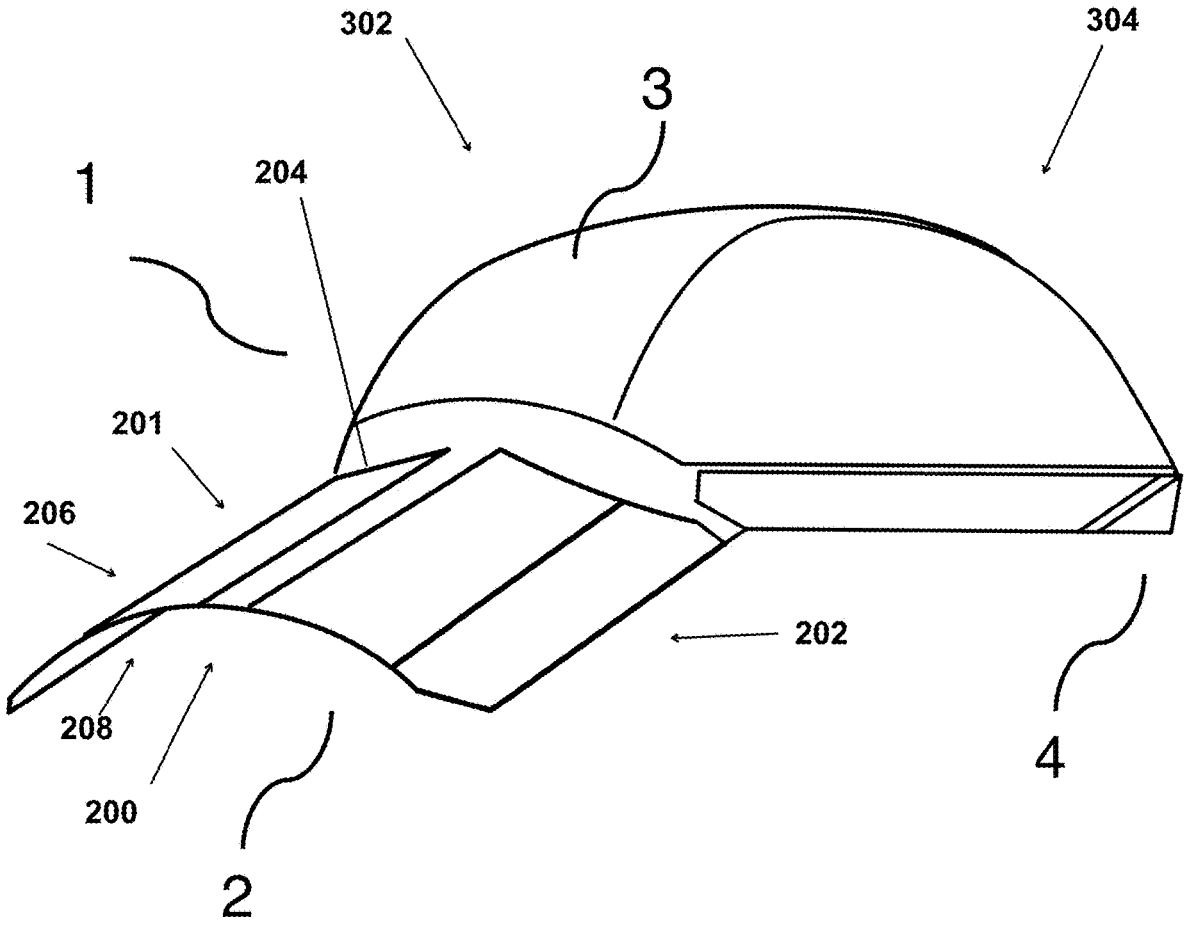
FIG. 1 shows an isometric view of a hat, according to some embodiments of the invention.

People wear hats to keep warm, protect their heads from sunlight and weather, provide shade for their eyes and face, and prevent sweat flowing into their eyes. Typically, people wear hats outdoors and during athletic pursuits or other rigorous activities. People move through different environments, leading to a need to remove and stow their hats.

People can wear displays to have quick and hands free access to a multitude of data and software applications. Typically, people wear displays assembled to eyeglass frames or goggle frames. People move through different environments, leading to a need to remove and stow their displays. Some embodiments of wearable headgear as described herein can advantageously and conveniently obviate the need to take a smartphone out of one's pocket, purse, or handbag to perform a number of functions.

Hats are made smaller through a variety of methods, including folding, crumpling, collapsing, and compressing. The most pervasive form of stowing a hat in a pocket or bag is to collapse the cap portion of the hat while compressing its bill. It can be advantageous to temporarily compress the hat so that it can be placed in a small opening of a pocket. Hats most commonly resist being made smaller and being placed in pockets. Hats bulge pockets outward, leading to uncomfortable, unsightly, and inefficient storage, and can sometimes fall out of their storage location due to unstable, unwieldy folding configurations. Stuffing hats in pockets deforms their visors, leading to an undesired appearance when worn that may not be fully reversible.

Unfortunately, conventional hats do not fold into flat shapes that fit easily into pockets. Hats that do provide a fold, such as on the visor, do not fold compactly to fit in typical pocket sizes. Hats that provide a partial fold do not fit into typical pockets without discomfort, unsightly appearance, or inefficient storage. The visors (e.g., brims) of hats are both delicate and resilient, they are easy to plastically deform to the point of damage and if deflected too far during insertion into a pocket can apply a residual force within the pocket, resulting in discomfort, an undesired appearance, and a reduction in available storage.

These limitations reduce the incidence of carrying hats for protection from the environment and as an aid in athletic pursuits. Current designs limit the utility and convenience of carrying hats.

Accordingly, in some embodiments, disclosed herein is a hat that folds flat without resilience or substantial resilience. In some embodiments, a hat in a wearable, unfolded configuration can have a cap opening volume to fit a user's head of between about 5,000 $cm^3$ to about 10,000 $cm^3$, between about 6,000 $cm^3$ and about 9,500 $cm^3$, or about, at least about, or no more than about 4,500 $cm^3$, 5,000 $cm^3$, 5,500 $cm^3$, 6,000 $cm^3$, 6,500 $cm^3$, 7,000 $cm^3$, 7,500 $cm^3$, 8,000 $cm^3$, 8,500 $cm^3$, 9,000 $cm^3$, 9,500 $cm^3$, 10,000 $cm^3$, 10,500 $cm^3$, 11,000 $cm^3$, 11,500 $cm^3$, 12,000 $cm^3$, 12,500 $cm^3$, or ranges including any two of the aforementioned values. In some embodiments, the hat as disclosed herein can have a folded device total volume of less than about, for example, 600 $cm^3$, 550 $cm^3$, 500 $cm^3$, 450 $cm^3$, 400 $cm^3$, 350 $cm^3$, 300 $cm^3$, 250 $cm^3$, 200 $cm^3$, 150 $cm^3$, 100 $cm^3$, 50 $cm^3$, 25 $cm^3$, 15 $cm^3$, 10 $cm^3$, 5 $cm^3$, or less, or ranges including any two of the aforementioned values. In some embodiments, the hat in its folded configuration can have a volume that is about or less than about 25%, 20%, 15%, 10%, 9%, 8%, 7%, 6%, 5%, 4%, 3%, 2%, 1%, or less or its total volume in a wearable unfolded configuration (and/or cap opening volume as disclosed above), or ranges including any two of the aforementioned values.

A hat that folds flat to place in a bag can be also advantageous in some embodiments as it allows options for placement among multiple items.

A hat as referred to herein can include any type of headwear, including but not limited to baseball caps, beanies, berets, boonies, bowlers, bucket hats, fedoras, hard hats, mortarboards, panama hats, planter's hats, sombreros, Stetsons, cowboy hats, ski caps, and trucker hats.

In some embodiments, disclosed herein is a display system integrated with the hat to display various interfaces, data, and communications, including but not limited to the internet, directions for navigation, video, games, technical information, anatomical information, news, phone graphical user interfaces (GUIs), text GUIs, video playing GUIs and music playing GUIs. The hat can be thin in some embodiments, but is not necessarily limited to a particular size. In some embodiments, the hat as disclosed herein can have a device total volume of less than about, for example, 800 $cm^3$, 750 $cm^3$, 700 $cm^3$, 650 $cm^3$, 600 $cm^3$, 550 $cm^3$, 500 $cm^3$, 450 $cm^3$, 400 $cm^3$, 350 $cm^3$, 300 $cm^3$, 250 $cm^3$, 200 $cm^3$, 150 $cm^3$, 100 $cm^3$, 50 $cm^3$, 25 $cm^3$, 15 $cm^3$, 10 $cm^3$, 5 $cm^3$, or less, or ranges including any two of the aforementioned values.

The displays can interface with various types of devices, including but not limited to machines, cameras, temperature controls, robotic devices, aircraft, automobiles, self-driving automobiles, flying drones, spaceships, satellites, weapons, computers, smartphones, telecommunication systems, haptics systems, game playing computers, game consuls, earphones, headphones, home appliances, tablets, projectors, retinal projectors, augmented reality (AR) systems, virtual reality (VR) systems, watches, surgical devices, physiological stimulators, and physiological sensors. The device can also include handheld controllers to provide input to the displays and/or other electronic elements.

In some embodiments, the displays can include blockchain information, such as QR code information to facilitate cryptocurrency transactions, for example. Other transactions can be completed via NFC, RFID, or other payment technology.

In some embodiments, a display can include any number of the foregoing features. For example, a display can project from near the forehead onto lenses folded down or otherwise attached from the visor. This can include, for example, projection and sensing of light dot array from tip of visor on to face (e.g., similar to the KINECT from Microsoft Corp., Redmond, Wash.). Systems can be used to read facial expressions, eyes, the mouth, etc. and interface with a cap AR system. A fresnel lens can also be used within the visor, or fold down lenses to create depth of image to reduce eye strain. The AR could include higher resolution and/or lower resolution features. Lower resolution features could be more economical and utilized for display of text messages, emoji, weather alerts, etc. In some embodiments, an opaque typical screen can be utilized and also readable without folding down from visor. The user can glance up at the visor for basic information including but not limited to arrows, colors, alerts, and/or images. An opaque typical screen can also be employed that folds down when the user does not need to see the environment directly. A camera in the visor or elsewhere on the hat could record and stream to a screen to create AR. The headband of the hat can be configured to change size, via a motor to create the sensation of squeezing of forehead (e.g., via a cable looped through the headband enabled by a DC motor with encoder wheel, stepper motor, and the like). Squeezing of forehead could be used as haptic feedback for games, remote control, alerts, feedback that pic has been taken, a "hug" sent from a friend, etc. In some embodiments, typical screens could be embedded in each half of visor pointing downward to project onto a fold out lens or mirror. Displays could also be viewable through lenses while still folded. Fold out mirrors at the tip of the visor could also reflect images on a typical screen or screens mounted near where the visor meets the forehead. In some embodiments, the head band of the hat could be used for bone conduction headphones to provide a more complete audio-visual experience. In other embodiments, fold-out more conventional head phones could also be utilized. In some embodiments, projectors mounted on the visor could also project a digital light field into the user's eye(s) or another desired location. The displays could sense capacitance/incorporate touchscreen elements in some cases.

In some embodiments, the hat also includes various electronic components, including any number of the following components. Each component can be placed in various locations of the hat as described elsewhere herein. The hat can include any number of sensors. The hat can also include integrated or attached earphones, In other embodiments, the hat includes temperature sensors. In still other embodiments, the hat includes heating elements. In some embodiments, the hat includes sensors that monitor physiological activity (including one or more of blood pressure, heart rate, EKG or PPG, EEG, HRV, respiratory rate, temperature, electrodermal sensors, pulse oximetry, and others). Physiologic sensors could be configured to contact the skin surface of the forehead, other areas of the head, ear lobe, inside of the ear via a probe, etc. or be wireless non-contact sensors that employ Doppler radar, lasers, and the like. Sensors could be both diagnostic and/or therapeutic (e.g., electrodes to deliver stimulation energy, electromagnets, ultrasound, RF, microwave energy, and the like). Some embodiments can also include one or more microphones (e.g., to record sound and/or measure sound readings in decibels, for example), and/or one or more speakers for delivering audio (for sharing music, amplifying sounds akin to a megaphone, or as an assistive device for visually impaired individuals). The hat can also incorporate weather sensors, such as humidity, temperature, wind speed, and barometric pressure. The hat can also include motion related sensors such as accelerometers, altimeters, and gyroscopes/inclinometers/tilt sensors to measure speed, distance tracking, altitude, and/or position. The hat can also include geolocation sensors, such as GPS. The hat can further include rotating displays to share video, not only with the user, but with others. The hat can also include climate control features such as a resistance heating coil within the hat for winter or cold days, or a fan for summer or hot days. The hat can also include communication modules (e.g., antennas to receive or send signals, including but not limited to FM radio, AM radio, HD radio, satellite radio, Wi-Fi, wideband, LTE, Bluetooth, NFC, GPS, and the like. In some embodiments, the hat can also include one or more lighting elements, such as LED lights. The lights can illuminate outward from the rear of the displays, similar to a headlamp. The hat can also include cameras to capture and/or display video, infrared cameras, radar, LIDAR, and the like to sense heat/presence of others/objects for first responder or military applications, gamma cameras to sense radiation, and the like. The hat can also include sensors for safety applications (e.g., smoke sensors for second hand smoke, gas sensors for noxious or toxic gases, including carbon monoxide or natural gas for example), light sensors, and/or proximity sensors.

Some embodiments can also include a memory to store data received from the sensors, and wired or wireless communication ports to transmit or receive data from the memory. The hat can also include one or more power sources, including but not limited to batteries, such as lithium ion batteries that can be charged via wires or wirelessly, e.g., via inductive coils. The hat can also include small wiper blades with or without small quantities of cleaning fluids such as alcohol to clean the displays. The hat can also include RFID and/or barcode readers to identify products, such as for price checking and comparison. The hat can further include a timekeeping element, e.g., a quartz crystal clock.

In some embodiments, the hat's display system may wirelessly communicate with a system that is connected to a network or cloud of data.

In some embodiments, provided is a closed loop control system for controlling temperature of the head. To meet this objective, heating elements and cooling mechanisms are contained within the hat as well as thermocouples and/or input devices that respond to a user's desire to increase or decrease the temperature around their head.

A hat can be constructed in multiple ways including operably assembling stiff panels between flexible sheets, bonding flexible sheets of varying thicknesses to one another, sewing flexible sheets to stiff panels, sewing flexible sheets of fabric of varying thicknesses, molding a polymer into panels and hinges, operably assembling hinges to panels, and using adhesive to join sheets to panels. In some embodiments, panels can have a durometer between about 20A and about 80A, between about 20A and about 60A, or between about 20A, 25A, 30A, 35A, 40A, 45A, 50A, 55A, 60A, 65A, 70A, 75A, 80A, or ranges including any two of the aforementioned values. In some embodiments, one piece of material can be folded, placed on a fixture, and then bonded to a second, different piece of material with different material properties to create an enclosed structure. In some embodiments, a visor can have a total thickness of about or no more than about 4 mm, 3.5 mm, 3 mm, 2.5 mm, 2 mm, 1.5 mm, 1 mm, 0.5 mm, or less, or ranges including any two of the aforementioned values. In some embodiments, a panel having a greater rigidity than the flexible layer(s) can have a thickness of, for example, no more than about 1 mm, 0.9 mm, 0.8 mm, 0.7 mm. 0.6 mm, 0.5 mm, 0.4 mm, 0.3 mm, 0.2 mm, 0.1 mm, or less, or ranges including any two of the aforementioned values. The flexible components (e.g., a fabric layer) can have, for example, a thickness of, for example, no more than about 0.8 mm, 0.7 mm. 0.6 mm, 0.5 mm, 0.4 mm, 0.3 mm, 0.2 mm, 0.1 mm, 0.05 mm, or less, or ranges including any two of the aforementioned values. In some embodiments, a hat folded flat can have a total folded thickness of between about 8 mm and about 10 mm, or less than about 12 mm, 11 mm, 10 mm, 9 mm, 8 mm, 7 mm, 6 mm, 5 mm, or ranges including any two of the aforementioned values, and a total surface area of less than about 300, 280, 260, 240, 220, 200, 180, 160, 140, 120, 100, 80, 60, or less $cm^2$, or ranges incorporating any two of the aforementioned values.

The hat can also take on various shapes, which allow for unique folding patterns and steps.

An isometric view of an embodiment of a hat 1 is shown in FIG. 1. Some embodiments of the hat 1 can include, for example, any number of a visor (brim) 2, a cap 3 that is operably connected to edges (e.g., the back edge) of the visor, and visor side arms 4. The visor 2 can include a first lateral zone 201 and a second lateral zone 202, a superior surface 206, an inferior surface 208, a front edge 202 and a back edge 204. The cap 3 can include a front portion 302 and a back portion 304.

The cap 3 can have a width of, for example, about, no more than about, or at least about 20 cm, 18 cm, 16 cm, 14 cm, 12 cm, 10 cm, 8 cm, 6 cm, 5 cm, 2.5 cm, 1 cm, or less or more, or ranges including any two of the aforementioned values. The visor can also have a width of for example, about, at least about, or no more than about 25 cm, 22 cm, 20 cm, 18 cm, 16 cm, 14 cm, 12 cm, 10 cm, or more or less, or ranges including any two of the aforementioned values. In some embodiments, the hat 1 can either have a closed top surface in which the user's head is covered (e.g., a baseball cap) or an open top surface exposing the top of a user's head (e.g., a sun or field visor hat). In some embodiments, the cap 3 has a generally curved top. The cap 3 may have, or does not have a flat (rectangular or square top crown) in some embodiments.

Figure 2A:
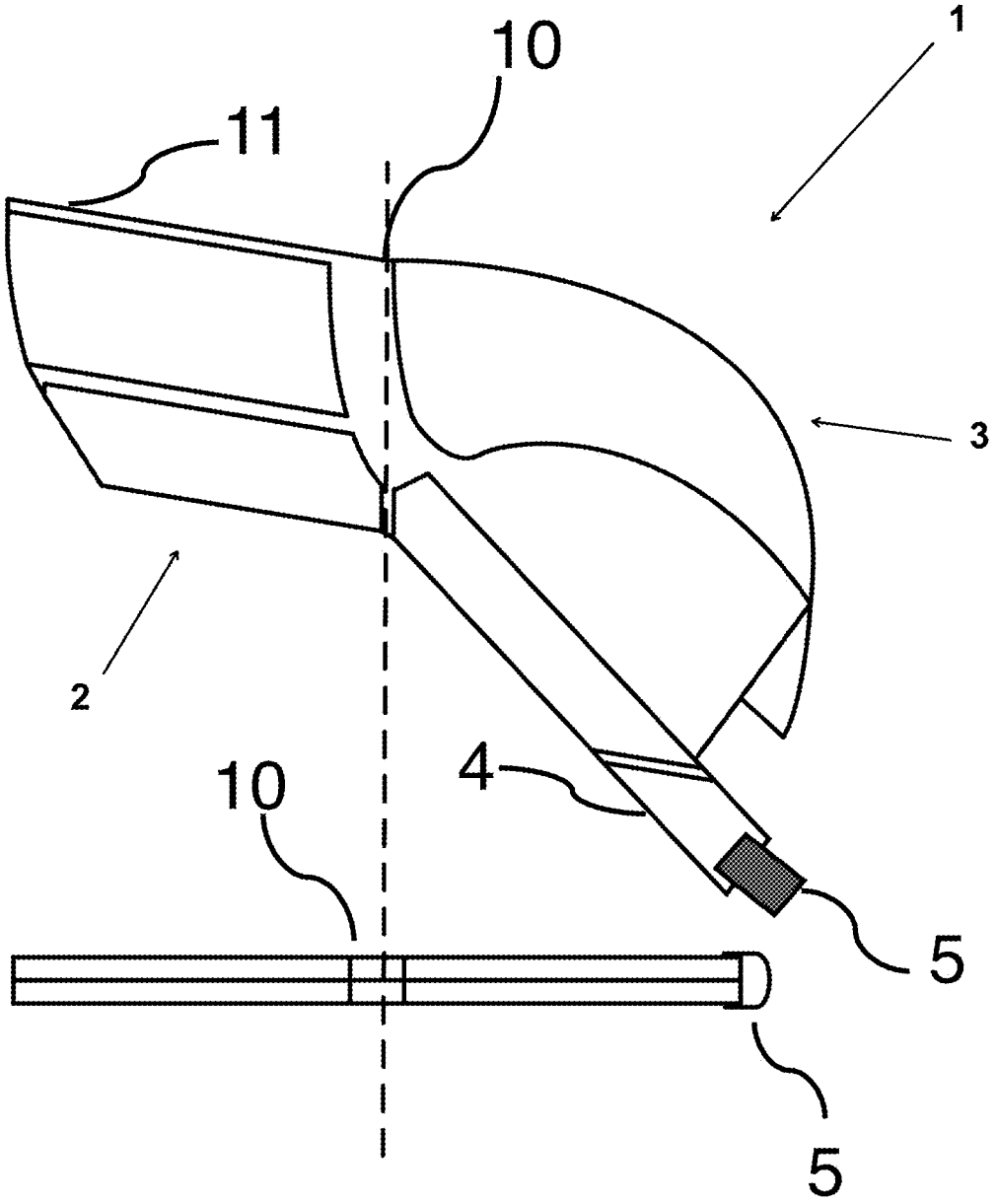
FIG. 2A shows a side view and a bottom view of a folded hat.

FIG. 2A shows a side view and a corresponding bottom view of a folded hat 1. Visor 2 can have a central longitudinal hinge 10 between the front edge of the cap 3 and the back edge of the visor 2, and/or a hinge 11 along a transverse axis of the visor 2. The visor 2 has a tether 5 that can be integral to the visor's arms 4 or operably assembled to the visor's arms 4. In still other embodiments, the tether 5 can be elastic or inelastic. In some other embodiments, the visor 2 can be elastic or inelastic.

Figure 2B:
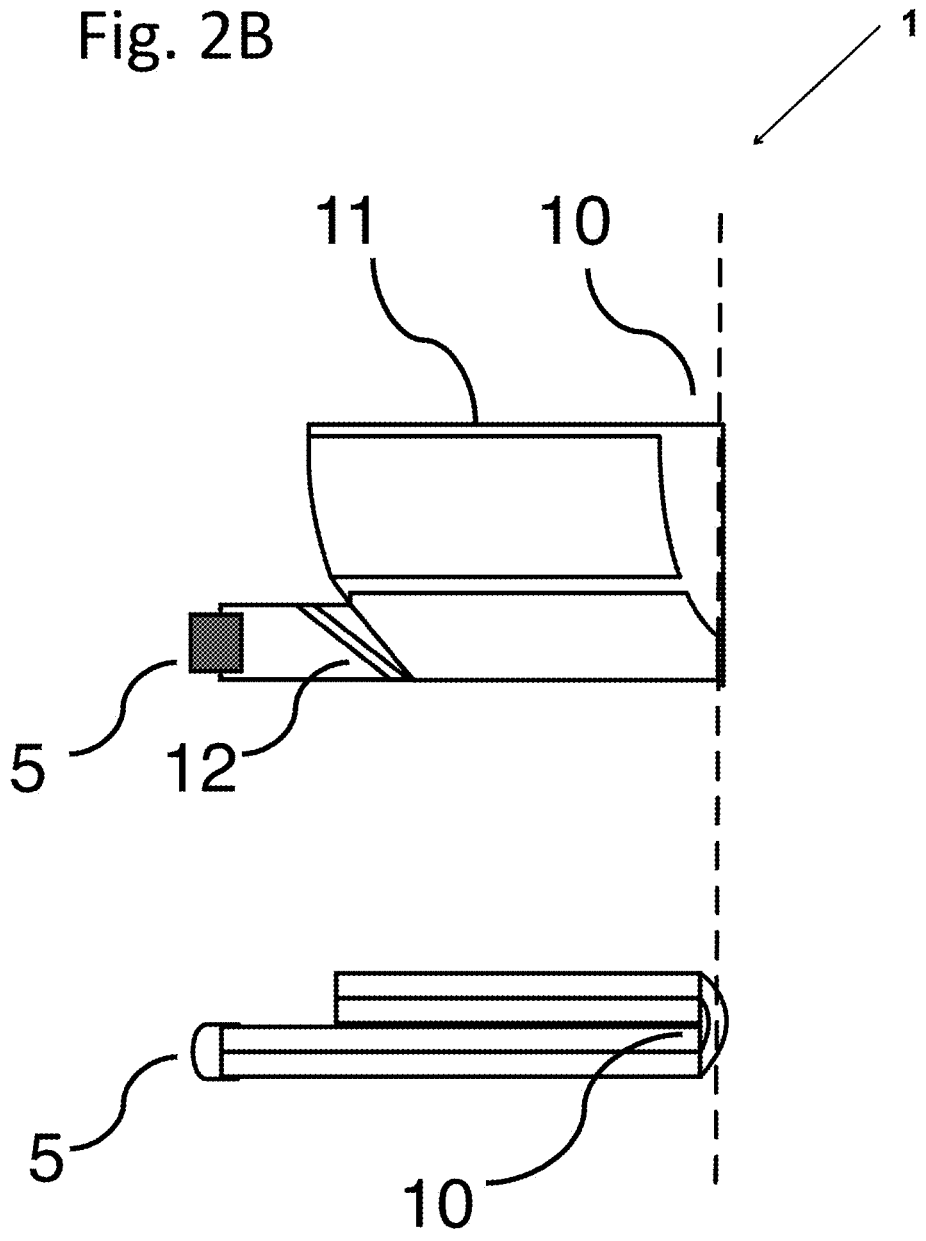
FIG. 2B shows a side view and a bottom view of a folded hat.

FIG. 2B shows a side view and a corresponding bottom view of a folded hat 1. Visor 2 can have a central hinge 10, and a hinge 11 along a transverse axis. In some embodiments, visor 2 can also include a hinge 12 along an arm 4. In some embodiments, the hat can stably fold along (e.g., by the virtue of hinges) exactly or no more than 5, 4, 3, 2, or 1 fold lines or axes. In some embodiments, the visor portion 2 can stably fold along only axes 10 and/or axes 11, but no other additional fold lines.

Figure 3A:
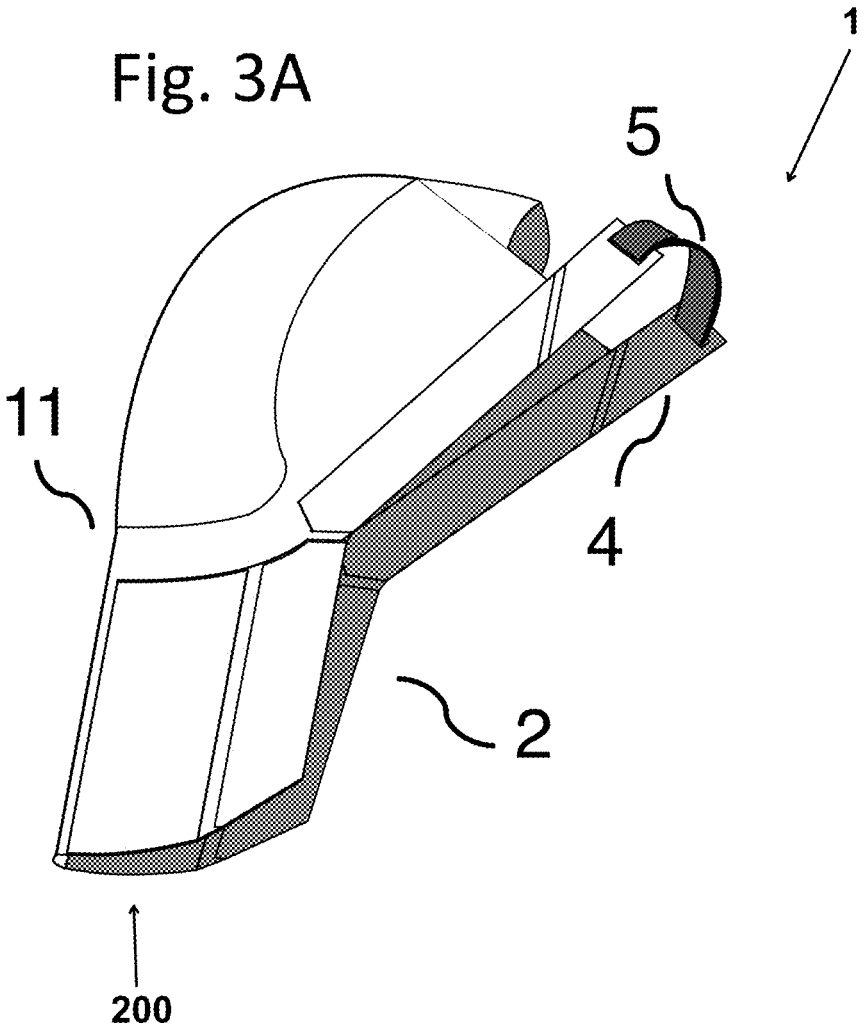
FIG. 3A shows an isometric view of a partially folded hat.

FIG. 3A illustrates an isometric view of a hat beginning to be folded along the axis of hinge 11. In some embodiments the folding can be initiated by pulling the tether 5 toward the front edge of the visor 2. In other embodiments, the folding can be initiated by collapsing the visor's front edge with one hand.

Figure 3B:
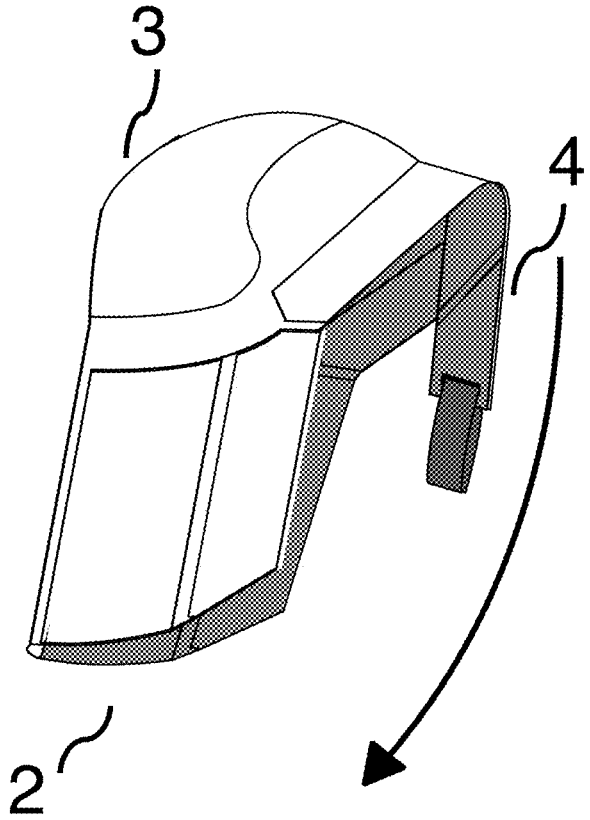
FIG. 3B shows an isometric view of a partially folded hat with a tether displaced towards the front end of the visor.

FIG. 3B illustrates an isometric view of a hat being folded by the collapsing of the visor 2 side arms 4 and the cap 3. In some embodiments, the visor's side arms 4 are pulled through the folding visor 2.

Figure 3C:
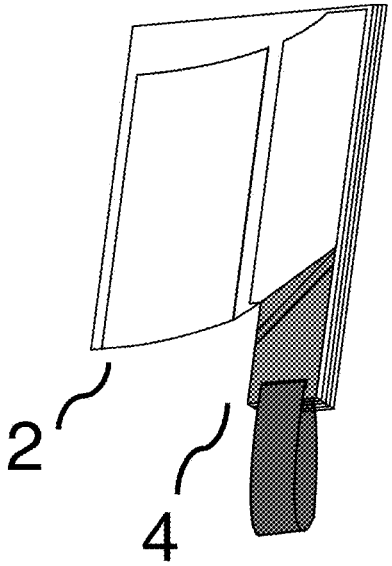
FIG. 3C shows an isometric view of a folded hat with a tether displaced in front of the front edge of the visor.

FIG. 3C illustrates an isometric view of a folded hat with the visor arms 4 surrounded by the front area of the visor 2, and where at least a portion of the visor arms 4 and the tether 5 extend outward beyond the visor 2.

Figure 3D:
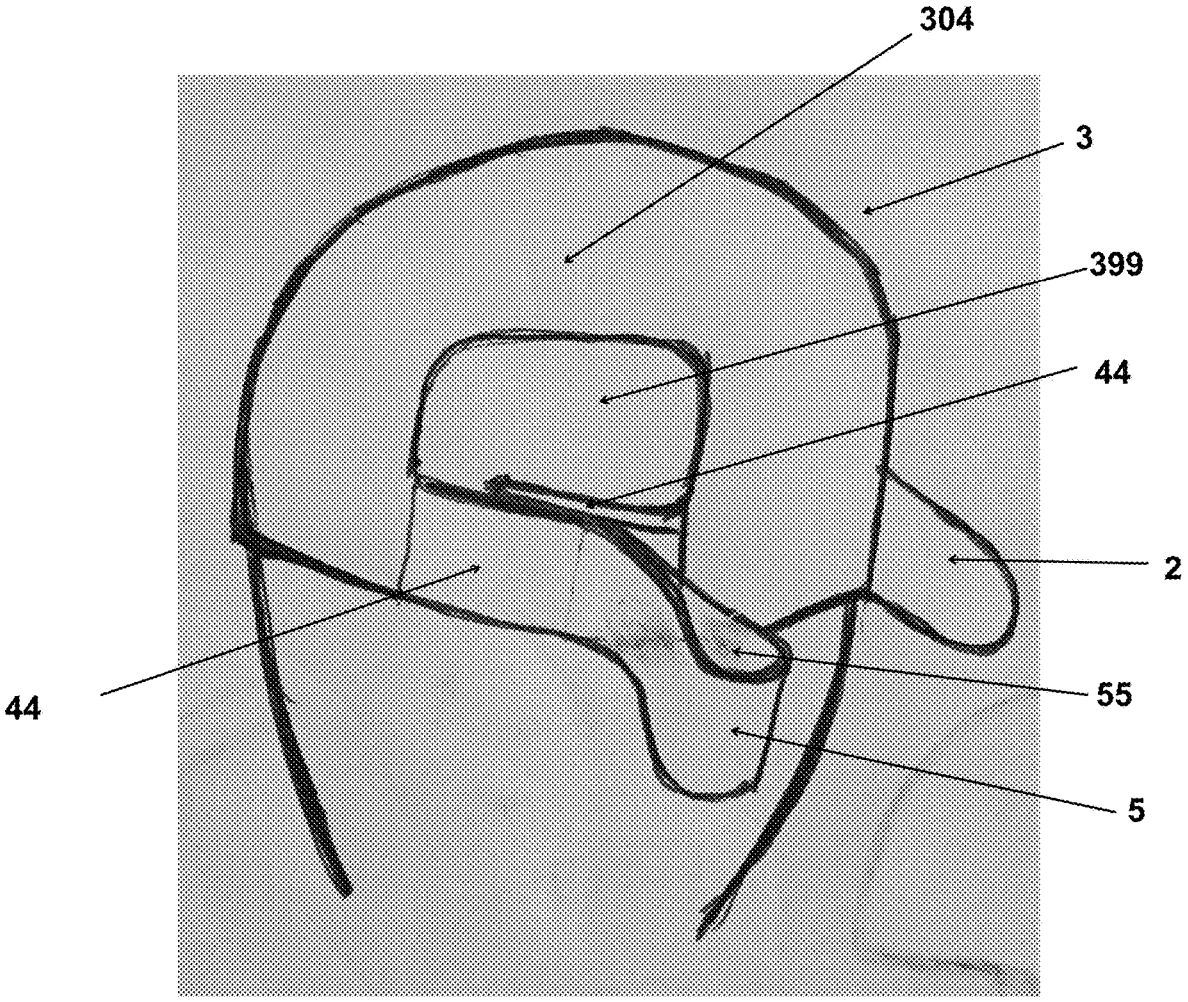
FIG. 3D illustrates a rear view of a hat including adjustment straps and a tether loop.

FIG. 3D illustrates a rear view of an embodiment of a hat, illustrating back portion 304 of cap 3, with complementary elongate adjustment straps 44 to adjust the hat size to an individual user's head. Visor 2 is also illustrated. The adjustment straps 44 could include hook-and-loop fastener material (e.g., Velcro), nib press fits, buckles, or other types of adjustment. A void space 399 can be present superior to the adjustment straps 44 to define a part of the superior edges of the adjustment straps 44. A tether 5 can be integrally formed with or attached to one of the adjustment straps 44, and optionally include a loop 55 as shown for simple grabbing by a user to promote both one-handed folding and unfolding of the hat.

Figure 4:
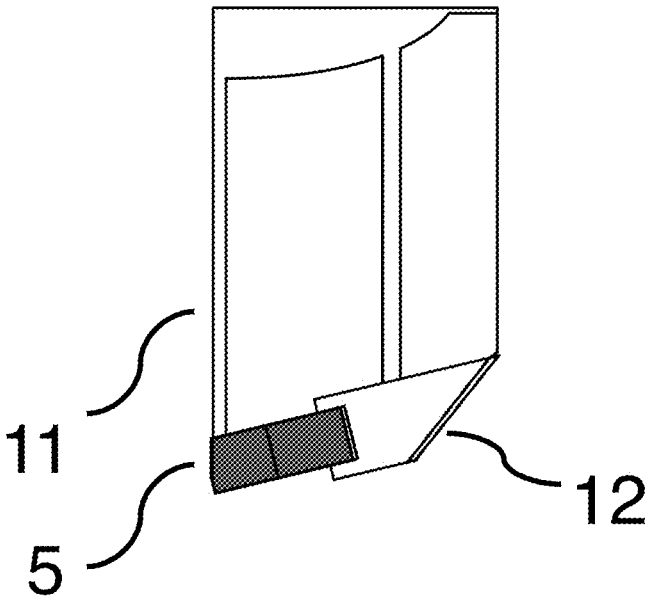
FIG. 4 shows a side view of a folded hat with a tether partially surrounding a visor.

FIG. 4 illustrates a side view of hat. In some embodiments, the visor's arms 4 have been folded using hinge 12. In still other embodiments, the tether 5 has surrounded the front area of visor 2 to operably hold the hat in the folded position. In some embodiments, the tether 5 has sufficient strength to stably compress the folded hat.

Figure 5A:
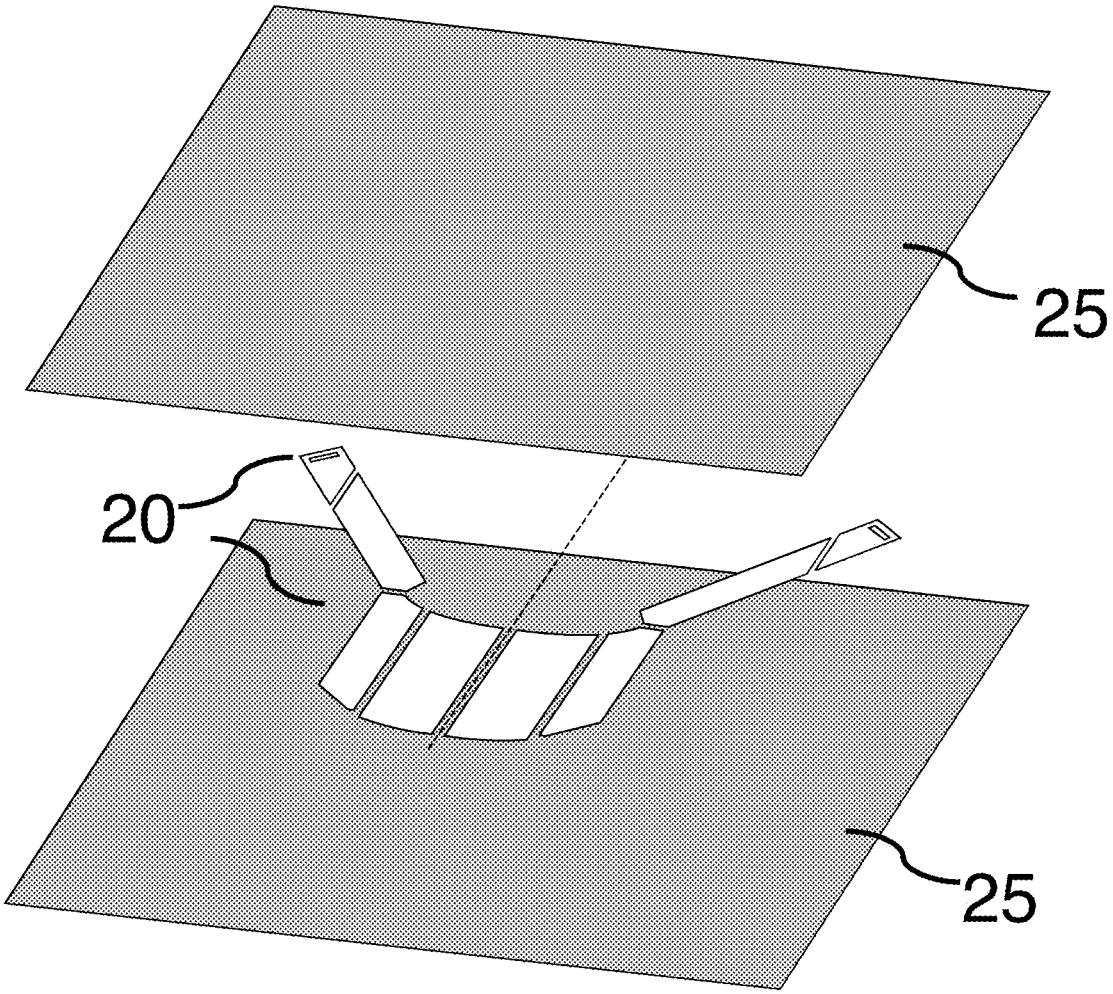
FIG. 5A shows an isometric view of sheets above and below panels.

FIG. 5A illustrates an isometric view of panels 20 and flexible sheets 25. In some embodiments, the panels 20 can be deformable, but are relatively more rigid than the flexible sheets 25. The flexible sheets 25 can be made of (or are not made of) any number of a fabric material including but not limited to cotton, wool, felt, nylon, or polyester, for example. In some embodiments, the panels 20 or flexible sheets 25 include, or do not include paper materials. In some embodiments, the flexible sheets 25 are operably assembled to one another and the panels 20. The panels 20 can be sandwiched in between a plurality of flexible sheets 25 in some cases and as such may not be the outermost or innermost layers of the hat. In some embodiments an adhesive operably assembles the panels 20 and flexible sheets 25 together. In still other embodiments, heating is used to melt materials to create an operable assembly. In other embodiments, the flexible sheet is sewn to the panels. While a number of panels 20 are shown in FIG. 5A it will be appreciated that a larger or smaller number of panels can be used, and some of the illustrated panels can be combined into less integrated panels, and/or subdivided into more panels, for example. Hinges could be present between some or all directly adjacent panels in some embodiments. A cap portion of the hat can include panels, or no panels at all in some embodiments. In some embodiments, the hat can include, or does not include any wire or other struts in the cap or visor portion. In some embodiments, the hat can, or does not include a flexible, generally non-deformable wire rope member, such as along a front edge of the cap or visor.

Figure 5B:
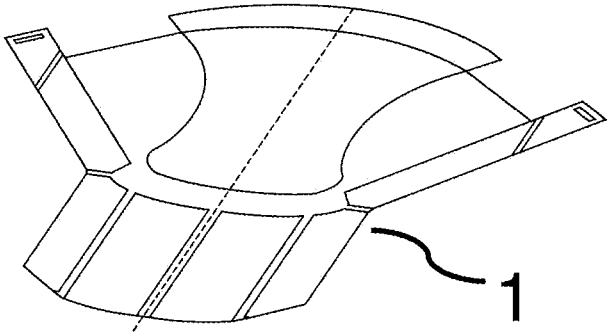
FIG. 5B shows an isometric view of a visor and a hat formed by a layering of panels and sheets with excess sheet trimmed away.
Figure 5B:
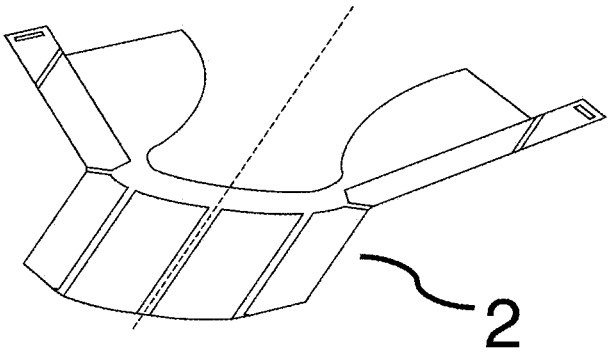

FIG. 5B illustrates an isometric view of a hat 1 and a visor 2. In some embodiments, capturing panels 20 between flexible sheets 25 forms a visor or a hat. In still other embodiments, the operable assembly of panels and hinges is molded out of a flexible polymer. In other embodiments, the excess sheet material is then trimmed to form a visor 2. In still other embodiments, the sheet material is stretchable, and forms an integrated cap area to form a complete hat 1. In still other embodiments, the visor's arms 4 are asymmetrical with one arm acting as a tether that operably connects with the other arm and itself to form the hat into a wearable shape. In some embodiments, the thin flat form of the hat is advantageous for packing and storing hats in large containers. In some embodiments, a hat includes a visor that only has side arms and a tether, without a top covering.

Figure 6A:
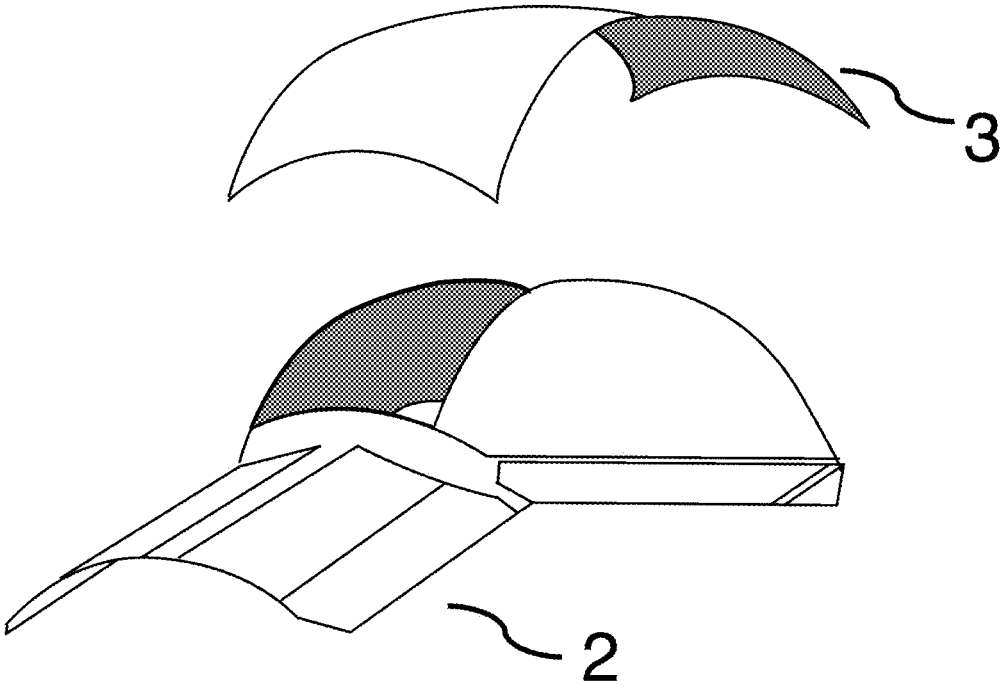
FIGS. 6A-6B show isometric views of a visor, a cap, and a hat.
Figure 6B:
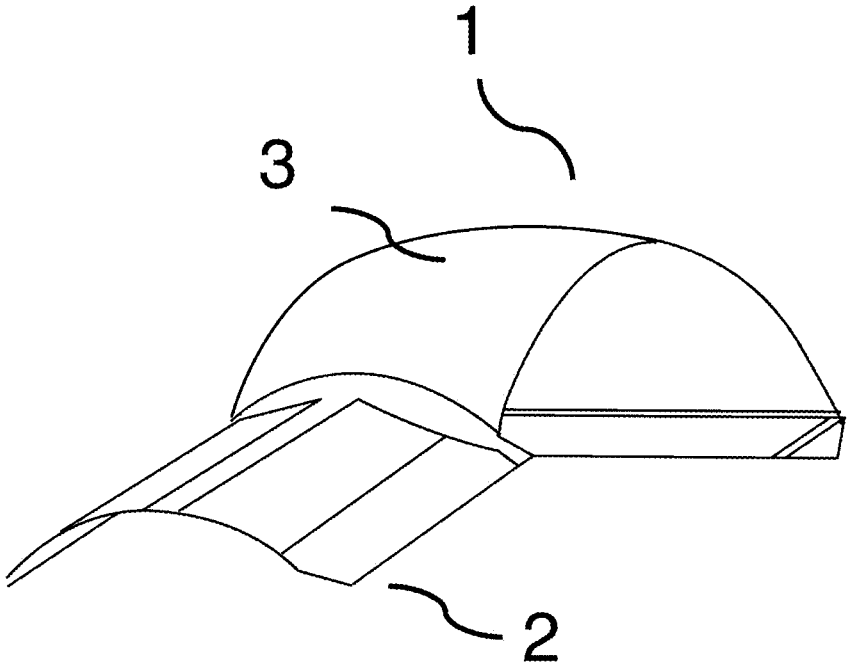

FIGS. 6A-6B illustrates two isometric views of the operable assembly of a cap 3 to a visor 2 to form a hat 1. The cap 3 can include an outer surface, inner surface, and an interior volume sized and configured to fit a user's head within the cap 3 when the cap 3 is in an expanded configuration. The cap can have a generally dome shape as shown, or a flat top portion or other geometry/hat style in other embodiments. In some embodiments the cap 3 can be integrally formed with, or operably assembled to the visor 2 via methods including heat, pressure, threads, sewing, and/or other techniques.

Figure 7:
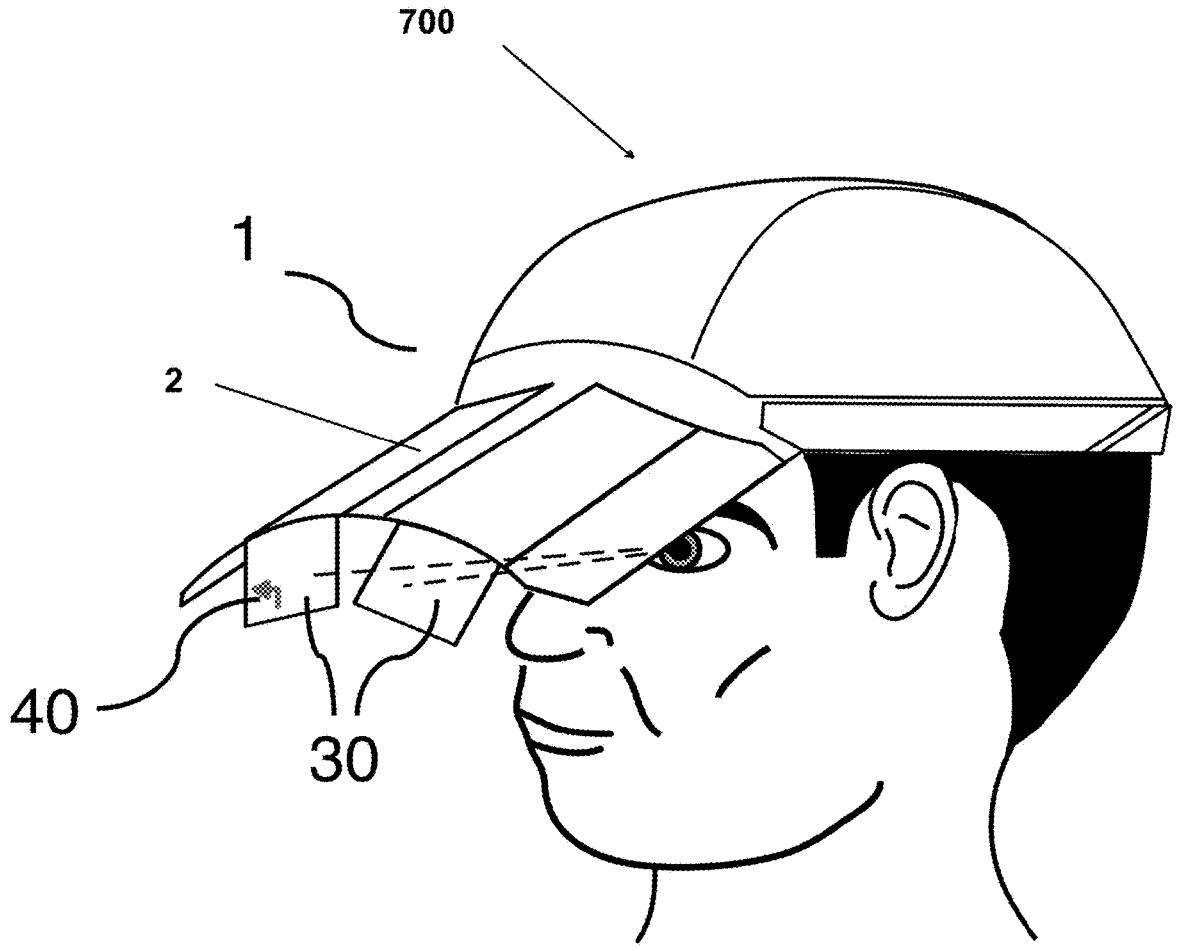
FIG. 7 shows an isometric view of a user viewing a hat's displays.

FIG. 7 illustrates an isometric view of a hat 700 with a plurality of displays 30 extending from its visor 2 (e.g., generally orthogonal to the inferior surface of the visor as shown), with a display 30 each on lateral zones of the visor 2. The displays could be, for example, an LCD display, LED display, OLED display, a mirror, or combinations thereof. One display can convey a navigation arrow 40 to direct the user to turn or move in the direction of the arrow, or other indicia. In some embodiments the displays 30 are operably assembled to the top surface of visor 2. In other embodiments, the displays 30 are operably assembled to the bottom surface of visor 2. In still other embodiments, the displays 30 are operably assembled to an edge (e.g., front, back, or lateral edges) of visor 2. In some embodiments the displays are operably assembled to the visor by various ways including but not limited by hinges, sliders, a four bar linkage, hooks and loops, buttons, a pocket, clips, adhesive, heat, pressure, sewn edges, a zipper, a snap fit, a press fit, a ratcheting band, a tied knot, a magnet, magnets, screws, a bayonet lock, a vacuum, a clamp, a pin, a motorized hinge, and/or combinations thereof.

Figure 8A:
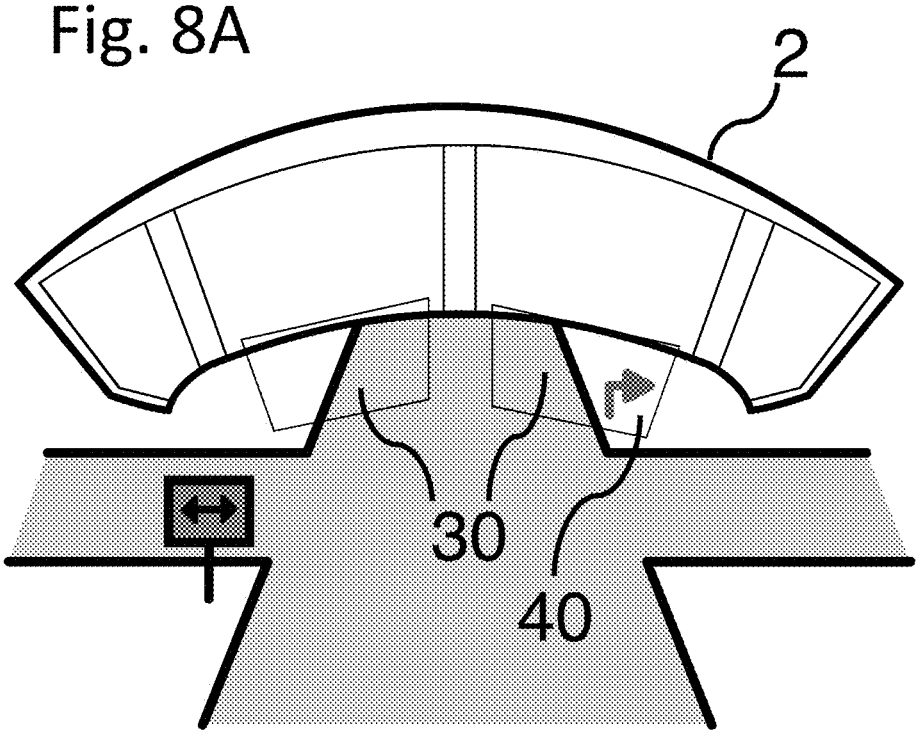
FIG. 8A shows the perspective of a user wearing a hat with two integrated displays, one of which is displaying an arrow.

FIG. 8A illustrates a three dimensional view of an intersection from the perspective of a user wearing a hat. The displays 30 are near, and/or attached near the front edge of the visor 2. One of the displays conveys a navigation arrow 40. In some embodiments, the displays communicate various interfaces, data, and communications, including but not limited to the internet, directions for navigation, speed, distance traveled or distance to target location, video, games, technical information, anatomical information, news, phone graphical user interfaces (GUIs), text GUIs, and music playing GUIs. In still other embodiments, the displays are transparent with translucent graphics. In other embodiments, displays could take the form of projectors that project an interface onto a surface operably assembled to the hat, similar to a head-up display, mirrors, optics, and/or the like.

Figure 8B:
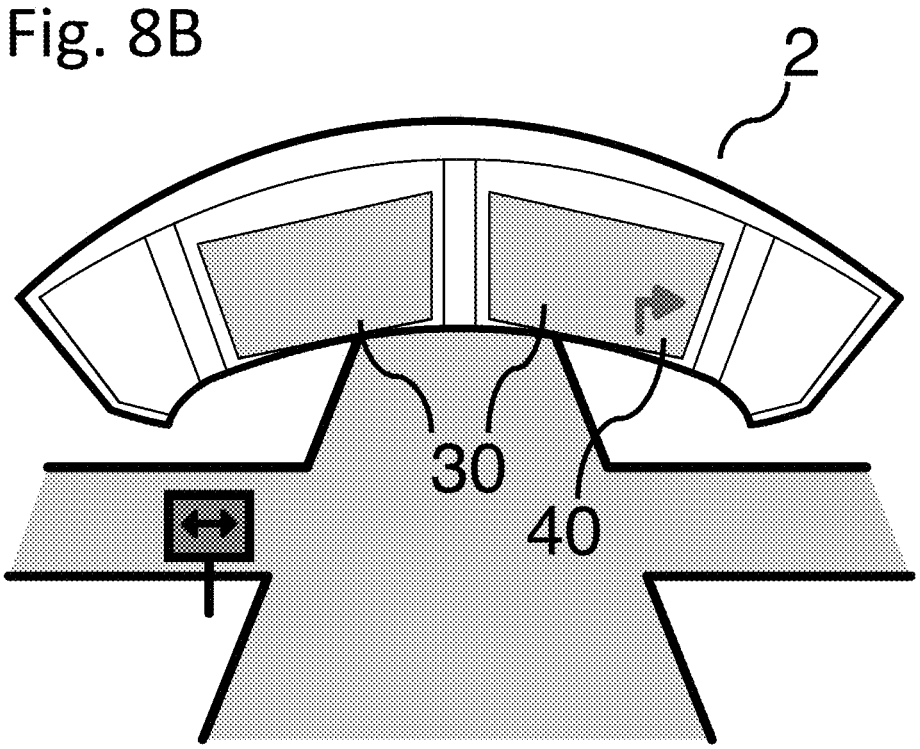
FIG. 8B shows the perspective of a user wearing a hat with two stowed integrated displays, one of which is displaying an arrow.

FIG. 8B illustrates a three dimensional view of an intersection from the perspective of a user wearing hat. The displays 30 are in a stowed position under the visor 2. One of the displays conveys a navigation arrow 40. In some embodiments, the displays 30 communicate various interfaces, data, and communications, including but not limited to the internet, directions for navigation, video, games, technical information, anatomical information, news, phone graphical user interfaces (GUIs), text GUIs, and music playing GUIs, or other features as disclosed elsewhere herein.

Figures 9A, 9B, 9C:
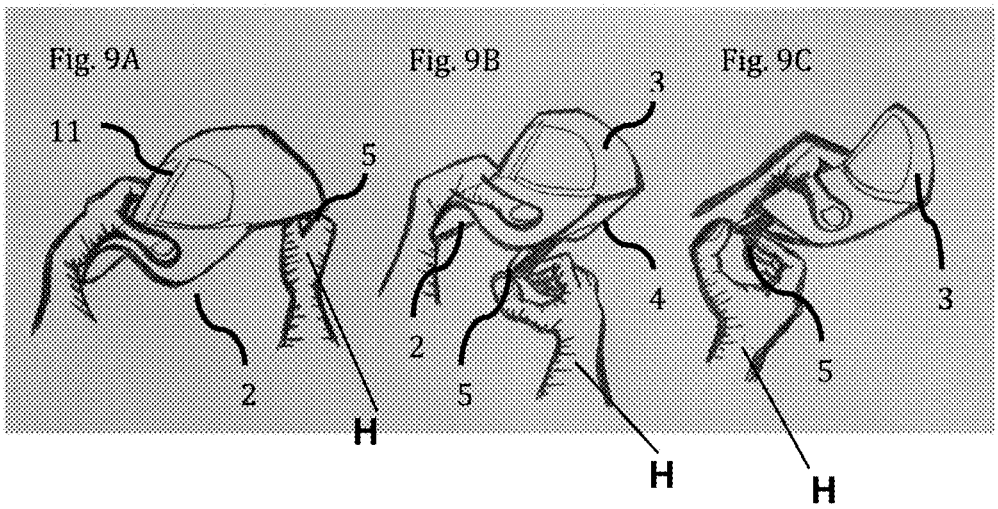
FIG. 9A illustrates an isometric view of a hat beginning to be folded along the axis of a hinge.
FIG. 9B illustrates an isometric view of a hat being folded by the collapsing of the visor side arms and the cap.
FIG. 9C illustrates an isometric view of a folded hat with the visor arms surrounded by the front area of the visor.

FIG. 9A illustrates an isometric view of a hat beginning to be folded along the axis of hinge 11, where the hinge is generally located along the central axis dividing the cap and/or visor into two lateral portions. In some embodiments the folding can be initiated by pulling with a user's hand H the tether 5 toward the front edge of the visor 2 (tether not shown in FIG. 9A). The tether could include a free end, or a loop in some embodiments. In other embodiments, the folding can be initiated by collapsing the visor's front edge with one hand. In still other embodiments, the collapsing can be initiated by simultaneously collapsing the visor's front edge with one hand, and pulling the tether 5 toward the front edge of the visor 2.

FIG. 9B illustrates an isometric view of a hat being folded by the collapsing of the visor 2 side arms 4 and the cap 3. In some embodiments, the visor's side arms 4 are pulled through the folding visor. In still other embodiments, the collapsing of the visor 2 side arms 4 and the cap 3 is simultaneous to the visor's side arms 4 being pulled through the folding visor.

FIG. 9C illustrates an isometric view of a hat in a folded configuration with the visor arms 4 surrounded by the front area of the visor 2, and a portion of the visor arms 4 extends outward from the front area of the visor 2. In some embodiments, pulling the tether 5 spreads apart the front area of the visor 2. In still other embodiments, pulling the tether 5 towards the rear of the hat expands the cap 3. A portion of the tether 5 can extend beyond the front end of the visor 2 in a folded configuration in some embodiments.

Figures 10A, 10B:
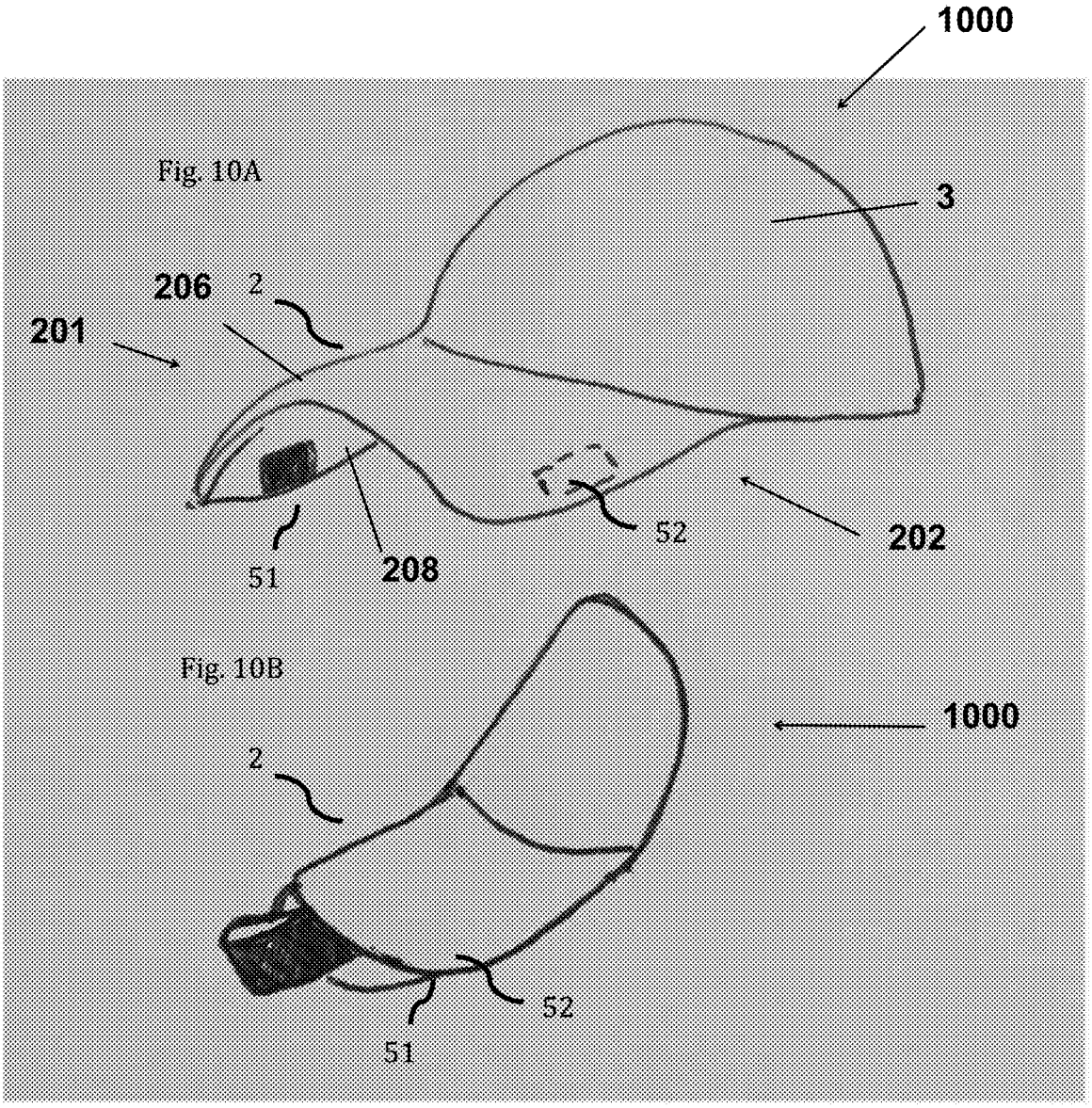
FIG. 10A illustrates an isometric view of a hat including self-closure elements.
FIG. 10B illustrates an isometric view of the hat of FIG. 10A in a folded position.

FIG. 10A illustrates an isometric view of a hat 1000. In some embodiments, the visor 2 includes a plurality of complementary reversible locking elements 51, 52 spaced apart from each other, and on discrete lateral zones 201, 202 of the visor 2 near or at the lateral edges of the visor 2 as shown. The locking elements 51, 52 can generally face each other in the wearable, unlocked configuration as shown. In some embodiments, the cap 3 can similarly include complementary locking elements. The locking elements 51, 52 can be operably attached to the superior surface 206 or inferior surface 208 of the visor 2 (may be advantageously more hidden to other observers if attached to the inferior surface 208), or hidden underneath a material layer (e.g., underneath a fabric layer of either the superior surface or inferior surface). The complementary locking elements 51, 52 can include, for example, hook-and-loop fastener material (e.g., Velcro), buttons, snap buttons, magnets and magnetic materials, metal, press fit bosses, clips, and/or snap fits. The reversible locking elements 51, 52 can be configured to reversibly mate when the hat 1000 assumes a folded configuration (as shown in FIG. 10B) and the first lateral zone 201 contacts the second lateral zone 202 in order to better maintain the hat 1000 in the folded configuration. In some embodiments, the reversible locking elements 51, 52 need not be made of the same materials as each other, and can serve other functions besides locking. For example, only one of the locking elements could be made of hook-and-loop fastener material (e.g., Velcro) while the complementary contralateral locking element is not made of hook-and-loop fastener material (e.g., Velcro). For example, the fabric covering layer of the visor integrally formed with the visor could function as the complementary locking element, reversibly attaching to an attached hook-and-loop fastener material element on the contralateral side. In other embodiments, one locking element could be a magnet, and the other locking element is not necessarily a magnet, but rather metal or other magnetically attractive electronics insert embedded in the contralateral side of the visor.

FIG. 10B illustrates an isometric view of the hat 1000 of FIG. 10A in a stably folded configuration. In some embodiments, locking elements 51, 52 operably hold the hat 1000 in the stably folded configuration. In some embodiments, locking elements 51, 52 join with the opposite side of the lateral zones of the visor 2 to operably hold the hat 1000 in the folded configuration.

Figures 11A, 11B:
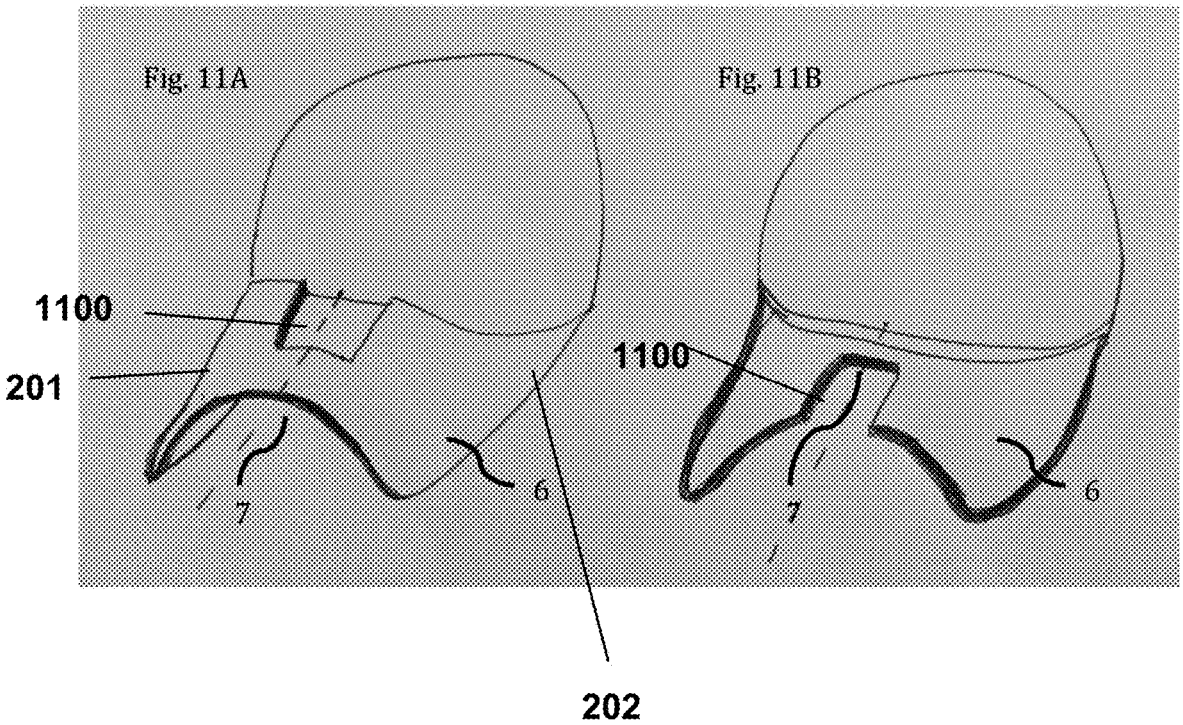
FIG. 11A illustrates an isometric view of a hat with a brim portion that maintains a radius in its folded state.
FIG. 11B illustrates an isometric view of another embodiment of a hat with a brim portion that maintains a radius in its folded state.

FIG. 11A illustrates an isometric view of a hat with an inner visor material layer 6 revealed (e.g., outer material, e.g., fabric layers sandwiching the inner visor material layer 6 not shown for clarity). The inner visor 6 has a bridge 7 spanning its two lateral zones 201, 202 (halves) at its front edge, and a void 1100 adjacent to and in the back of the bridge 7. The bridge 7 maintains a curvature (e.g., concave down) in the expanded configuration as shown as well as the folded configuration, such that the folded visor maintains a radius by virtue of the properties of the material layer, and is not bent into a sharp fold in the folded configuration. In some embodiments, the folded visor maintains a minimum radius of curvature of about or at least about 1 mm, 2 mm, 3 mm, 4 mm, 5 mm, 6 mm, 7 mm, 8 mm, 9 mm, 10 mm, or ranges including any two of the aforementioned values. In some embodiments, In some embodiments, the bridge 7 can be made of, for example, a plastic, a metal, a spring steel, rubber, an elastomer, nitinol, foam, a fabric, and combinations thereof. In some embodiments, the bridge 7 can additionally or alternatively be made of a silicone material or a polymer, such as PEEK or a high performance polymer. In other embodiments, the inner visor 6 is a continuous sheet that does not include a bridge or void portions.

FIG. 11B illustrates an isometric view of a hat with the inner visor 6 revealed, similar to that of FIG. 11A except that the inner visor 6 has a bridge 7 between its two lateral zones (halves) at its rear edge, and a void 1100 in front of the bridge 7. In some embodiments, a flexible covering encases inner visor 6. The flexible covering naturally curves at the front edge of the inner visor 6. The flexible covering maintains a curvature of the visor as shown in its folded configuration, and can readily also return to its unfolded wearable configuration.

In some embodiments, the void can comprise between about 5% and about 50% of the total surface area of the inner visor 6, or about, at least about, or no more than about 2%, 3%, 4%, 5%, 10%, 15%, 20%, 25%, 30%, 35%, 40%, 45%, 50%, 55%, 60%, 65%, 70%, or 75% of the total surface area of the inner visor 6, or ranges including any two of the aforementioned values. As illustrated in FIGS. 11A-11B, the void 1100 can define part of the peripheral edge of the inner visor layer.

Figures 12A, 12B, 12C, 12D, 12E:
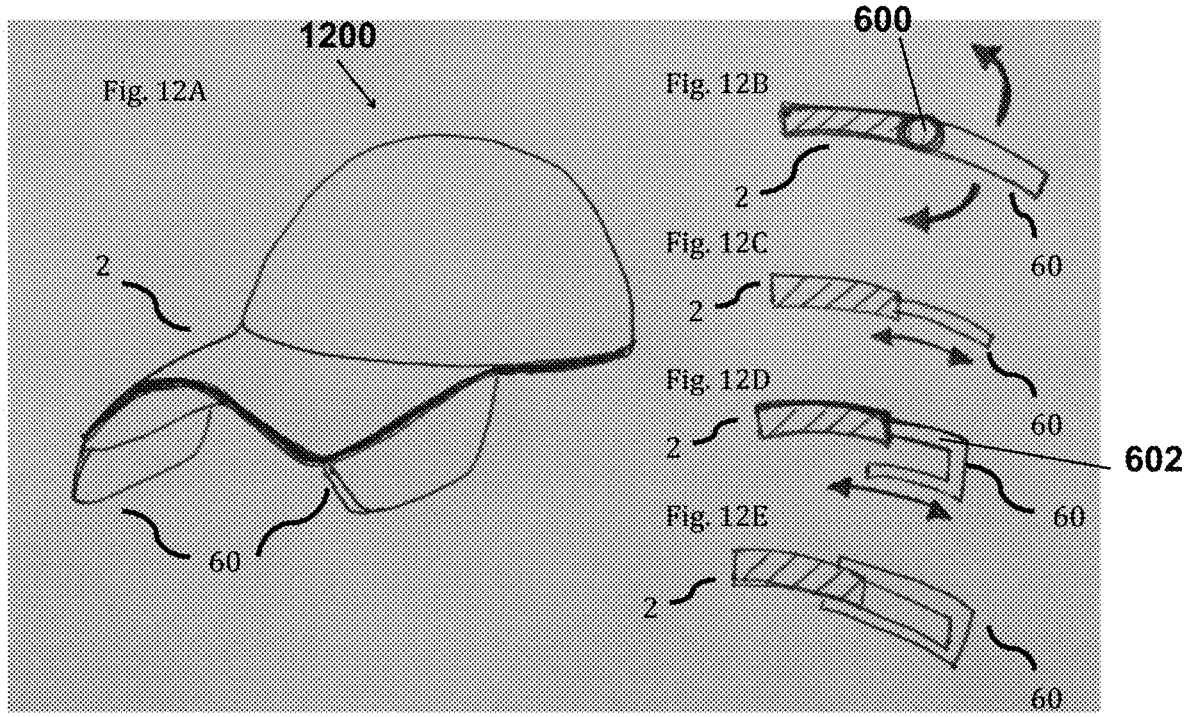
FIG. 12A illustrates an isometric view of a hat with two displays extending from its visor.
FIG. 12B illustrates a front view of a section of the visor with one display.
FIG. 12C illustrates a front view of a section of the visor with one display.
FIG. 12D illustrates a front view of a section of the visor with one display.
FIG. 12E illustrates a front view of a section of the visor with one display.

FIG. 12A illustrates an isometric view of a hat 1200 with two displays 60 extending from its visor 2, such as from the lateral sides of the visor as shown. The positions of the displays 60 can provide a wide viewing angle to the user of displayed images. In some embodiments, the viewing angle can be about or at least about 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, or more degrees, or ranges incorporating any two of the aforementioned values. A significant problem with head-mounted displays is the narrow field of view. A narrow field of view reduces the scale and range of positions of images displayed. A narrow field of view also reduces the realism of displayed images as they are only seen in a narrow field of view directly in front of the user. In some embodiments the displays 60 are operably assembled to the top of visor 2. In other embodiments, the displays 60 are operably assembled to the bottom of visor 2. In still other embodiments, the displays 60 are operably assembled to an edge (e.g., front and/or lateral edges) of visor 2. In some embodiments the displays 60 are operably embedded in visor 2. In some embodiments the displays are operably assembled to the visor by a means including but not limited by hinges, sliders, a four bar linkage, hooks and loops, buttons, a pocket, clips, adhesive, heat, pressure, sewn edges, a zipper, a snap fit, a press fit, a ratcheting band, a tied knot, a magnet, magnets, screws, a bayonet lock, a vacuum, a clamp, a pin, Velcro, overmolding, and a wedge. In some embodiments, the displays can manually or automatically pivot from a stowed configuration to a viewing configuration, such as via a hinge.

FIG. 12B illustrates a front view of a section of the visor 2 with one display 60. In some embodiments, the display 60 rotates upward at pivot point 600 and on to the top of visor 2. In other embodiments, the display 60 rotates downward and on to the bottom of visor 2. In still other embodiments, the display 60 rotates into an opening within the visor 2. The display 60 can be configured to rotate at least about 45, 90, 135, 180, or more degrees in one or more desired directions.

FIG. 12C illustrates a front view of a section of the visor 2 with one display 60. Rather than rotating on a pivot point as shown in FIG. 12B, the display 60 can slide in and out of the visor 2, utilizing side rails or slots for example.

FIG. 12D illustrates a front view of a section of the visor 2 with one display 60. The display 60 slides in and out of the visor 2 somewhat similar to shown in FIG. 12D. The display 60 can be integrally or otherwise attached to a mounting element 602 which slides in and out of the visor 2 while the display need not necessarily slide in and out of the visor 2 itself. The mounting element 602 could have an angled portion, such as right angles as shown to mount the display thereon, or other desired angles. The mounting element 602 could additionally or instead incorporate one or more pivot points similar to that shown in FIG. 12B for example.

FIG. 12E illustrates a front view of a section of the visor 2 with one display 60. The display 60 slides adjacent the visor 2, e.g., with rails or slots on an outer surface of the visor 2, in contrast to FIGS. 12C-12D of which the display 60 slides with respect to an inner surface of the visor 2.

While some embodiments have been described in the context of only a single display, some embodiments could also have a plurality of displays, such as 2, 3, 4, 5, or more displays for example.

Figure 13A:
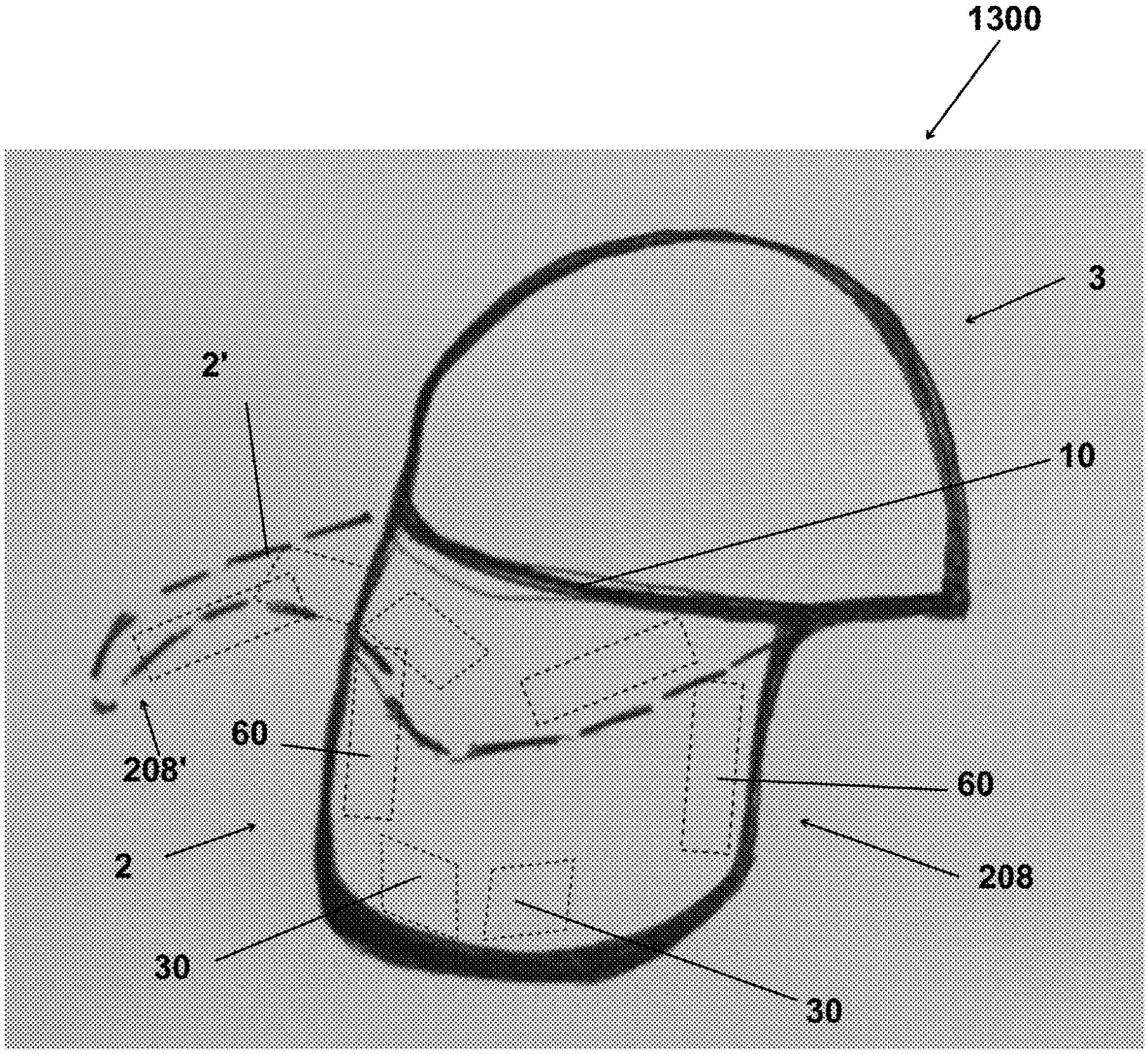
FIG. 13A illustrates an isometric view of a hat with its visor displaced downward.

FIG. 13A illustrates an isometric view of a hat 1300 with its visor 2 displaced downward from a more horizontal orientation (in phantom as 2', with inferior surface 208') utilizing a hinge 10 adjacent the back end of the visor 2 for example. The downward displacement of the visor 2 (e.g., from horizontal) between, for example, about 10 degrees and about 90 degrees provides a viewing surface for the wearer of the hat 1300. In some embodiments, this viewing surface includes one, two, or more displays 30 and/or 60 as described elsewhere herein. In some embodiments, the displays can be attached to the inferior surface 208 (e.g., underside) of the visor 2 somewhat similar to a visor sunshade of an automobile.

Although certain embodiments of the disclosure have been described in detail, certain variations and modifications will be apparent to those skilled in the art, including embodiments that do not provide all the features and benefits described herein. It will be understood by those skilled in the art that the present disclosure extends beyond the specifically disclosed embodiments to other alternative or additional embodiments and/or uses and obvious modifications and equivalents thereof. In addition, while a number of variations have been shown and described in varying detail, other modifications, which are within the scope of the present disclosure, will be readily apparent to those of skill in the art based upon this disclosure. It is also contemplated that various combinations or sub-combinations of the specific features and aspects of the embodiments may be made and still fall within the scope of the present disclosure. Accordingly, it should be understood that various features and aspects of the disclosed embodiments can be combined with or substituted for one another in order to form varying modes of the present disclosure. Thus, it is intended that the scope of the present disclosure herein disclosed should not be limited by the particular disclosed embodiments described above. For all of the embodiments described above, the steps of any methods need not be performed sequentially. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers (e.g., about 10%=10%), and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

What is claimed is:

1. A wearable hat configured to fold flat, comprising:

a cap portion comprising a front end and a back end, an interior volume configured to house the head of a user in an expanded configuration, and a longitudinal axis demarcating a first lateral zone, a second lateral zone, and a hinge therebetween configured to allow folding of the cap portion along the longitudinal axis, the first lateral zone and the second lateral zone each comprising a panel proximate the front end of the cap portion connected by the hinge, wherein the panels are situated in between a plurality of fabric layers of the cap portion, the panels made of a material that is more rigid than that of the fabric layers;

a visor portion extending from the front end of the cap portion, the visor portion comprising a superior surface, an inferior surface opposite the superior surface, and a central hinge disposed between a first lateral zone and a second lateral zone of the visor portion, each of the first and the second lateral zones having a lateral free edge, wherein the cap portion folds along the hinge to place the first and the second lateral zones of the cap portion proximate to each other and the visor portion folds along the central hinge to place the first and the second lateral zones of the visor portion proximate to each other such that the wearable hat is in a folded configuration that is substantially flat a plurality of side arms and a tether operably connected to the side arms that is configured to be manipulated by the user to transform the wearable hat from the expanded configuration to the folded configuration, wherein at least a portion of the tether is disposed beyond a front edge of the visor portion in the folded configuration.

2. The wearable hat of claim 1, wherein the inferior surface of the visor portion comprises a plurality of spaced-apart complementary reversible locking elements proximate each of the lateral free edges, the reversible locking elements configured to reversibly mate when the hat assumes a folded configuration and the first lateral zone contacts the second lateral zone.

3. The wearable hat of claim 1, wherein the panels do not extend into the back end of the cap portion.

4. The wearable hat of claim 1, wherein the hinge of the cap portion is substantially aligned with the central hinge, and wherein the hinge of the cap portion folds such that the first and the second lateral zones of the cap portion are disposed proximate each other in the folded configuration.

5. The wearable hat of claim 1, wherein the tether is disposed proximate the inferior surface of the visor portion in the folded configuration.

6. The wearable hat of claim 1, wherein the plurality of side arms are disposed proximate the panels in the folded configuration.

7. The wearable hat of claim 1, wherein at least a portion of the tether is disposed between the first and the second lateral zones of the visor portion in the folded configuration.

8. The wearable hat of claim 1, wherein the back end of the cap portion is disposed between the first and second lateral zones proximate the front end of the cap portion in the folded configuration.

9. A wearable hat configured to fold substantially flat, the wearable hat comprising:

a cap portion comprising a front end and a back end, an interior volume configured to receive the head of a user in an expanded configuration, and a longitudinal axis defining a first later zone, second lateral zone, and a hinge therebetween that is configured to enable the cap portion to fold along the longitudinal axis such that the first and the second lateral zones are disposed proximate to each other, the first and the second lateral zones each comprising a panel proximate the front end of the cap, wherein each of the panels are disposed between a plurality of fabric layers of the cap portion, the panels being made of a material that is more rigid that that of the fabric layers;

a visor portion extending from the front end of the cap portion, the visor portion comprising a superior surface, an inferior surface opposite the superior surface, and a central hinge disposed between a first lateral zone and a second lateral zone of the visor portion, each of the first and the second lateral zones having a lateral free edge; and a tether operatively connected to a plurality of side arms at the rear end of the cap portion, the tether configured to be manipulated by the user to transform the wearable hat from the expanded configuration to the folded configuration that is substantially flat;

wherein at least a portion of the tether is disposed proximate the inferior surface and between the first and the second lateral zones of the visor portion in the folded configuration, and wherein the back end of the cap portion is disposed between the first and the second lateral zones of the cap portion in the folded configuration.

10. The wearable hat of claim 9, wherein the panels do not extend into the back end of the cap portion.

11. The wearable hat of claim 9, wherein at least a portion of the tether is disposed beyond a front edge of the visor portion in the folded configuration.

12. The wearable hat of claim 9, wherein the plurality of side arms are disposed proximate the panels of the cap portion in the folded configuration.

13. The wearable hat of claim 9, wherein the back end of the cap portion is disposed between the first and second lateral zones proximate the front end of the cap portion in the folded configuration.

14. A method of folding a wearable hat from an expanded configuration into a folded configuration, the method comprising:

grasping a visor portion of the wearable hat;

grasping a tether operatively connected to a plurality of side arms that are coupled to a back end of a cap portion of the wearable hat;

pulling the tether toward a front edge and proximate an inferior surface of the visor portion of the wearable hat such that the back end of the cap portion is disposed between first and second lateral zones proximate a front end of the cap portion and at least a portion of the tether is disposed proximate an inferior surface of the visor portion;

collapsing the visor portion along a central hinge; and collapsing the cap portion along a hinge that is substantially aligned with the central hinge of the visor portion.

15. The method of claim 14, wherein collapsing the visor portion along the central hinge comprises folding a first lateral zone and a second lateral zone of the visor portion towards each other about the central hinge such that the first and the second lateral zones of the visor portion are disposed proximate each other.

16. The method of claim 14, wherein collapsing the cap portion along the hinge that is substantially aligned with the central hinge of the visor portion comprises folding the first and the second lateral zones of the cap portion towards each other about the hinge such that the first and the second lateral zones of the cap portion are disposed proximate each other.

17. The method of claim 14, wherein pulling the tether toward the front edge of the visor portion comprises positioning a portion of the tether beyond the front edge of the visor portion.

18. A wearable hat configured to fold flat, comprising:

a cap portion comprising a front end and a back end, an interior volume configured to house the head of a user in an expanded configuration, and a longitudinal axis demarcating a first cap lateral zone comprising a first cap panel, a second cap lateral zone comprising a second cap panel, and a hinge therebetween comprising a valley between the first cap panel and the second cap panel configured to allow folding of the cap portion along the longitudinal axis, the first cap panel and the second cap panel proximate the front end of the cap portion connected by the hinge, wherein the first cap panel and the second cap panel are situated in between a plurality of fabric layers of the cap portion, the first cap panel and the second cap panel made of a material that is more rigid than that of the fabric layers;

a visor portion extending from the front end of the cap portion, the visor portion comprising a superior surface, an inferior surface opposite the superior surface, a first visor lateral zone comprising a first visor panel, a second visor lateral zone comprising a second visor panel, and a central hinge comprising a central valley disposed between the first visor panel and the second visor panel, each of the first and the second lateral zones having a lateral free edge, the valley and the central valley aligned longitudinally, wherein the cap portion folds along the hinge to place the first and the second cap lateral zones of the cap portion proximate to each other and the visor portion folds along the central hinge to place the first and the second visor lateral zones of the visor portion proximate to each other such that the wearable hat is in a folded configuration that is substantially flat.

* * * * *